US005180066A

United States Patent [19]

McArdle

[11] Patent Number: 5,180,066

[45] Date of Patent: Jan. 19, 1993

[54] WINE BOTTLE HOLDER AND DISPLAY RACK

[76] Inventor: Christopher J. McArdle, P.O. Box 212, Montclair, Calif. 91763

[21] Appl. No.: 871,130

[22] Filed: Apr. 20, 1992

[51] Int. Cl.[5] ..... A47F 7/00

[52] U.S. Cl. ..... 211/74; 211/73; D6/616

[58] Field of Search ..... 211/74, 70.1, 73, 60.1; D7/616, 617; 248/512

[56] References Cited

U.S. PATENT DOCUMENTS

| | | | |
|---|---|---|---|
| D. 252,065 | 6/1979 | Leoenthal | D7/616 |
| D. 255,520 | 6/1980 | Lyons | D7/616 X |
| 2,155,884 | 4/1939 | Barnes | 211/74 |
| 2,338,310 | 1/1944 | Barnes | 211/74 |
| 3,901,389 | 8/1975 | Belokin, Jr. | 211/74 |
| 3,964,709 | 6/1976 | LaBelle et al. | 211/73 X |
| 4,496,124 | 1/1985 | Cole | 248/146 |
| 4,515,334 | 5/1985 | Horne | 248/146 |
| 4,795,038 | 1/1989 | Johnson | 211/74 |

*Primary Examiner*—Robert W. Gibson, Jr.

[57] ABSTRACT

A one-piece bottle rack for the horizontal storage and display of long-necked bottles and which is formed of a plastic, such as acrylic or other appropriate material, the rack having a planar base member with an opening extending inwardly from one end of the base member and terminating at a transverse axis, the opening being bordered by support arms integral with the base and extending outwardly from the transverse axis to the open end of the base, and the rack also including an inclined planar ramp member formed integral with the base at the transverse axis, the ramp member being formed from the same piece of material as the base member, and the ramp member having a plurality of holes for receiving the necks of and supporting one or more wine bottles in generally spaced and parallel relationship with one another and with the base, and with the wine bottles extending along the base toward the other end of the base.

2 Claims, 1 Drawing Sheet

WINE BOTTLE HOLDER AND DISPLAY RACK

BACKGROUND OF THE INVENTION

The invention relates to a bottle rack for the horizontal storage and display of long-necked bottles, typically wine bottles, and particularly to a one-piece rack which supports one or more bottles solely by their necks.

Bottle racks are known for supporting wine bottles with the neck of each bottle extending through a corresponding opening in an upstanding column. U.S. Pat. No. 3,901,389, for example, discloses such a rack which includes a vertical column with a number of holes formed in the column for receiving the necks of wine bottles to provide a support for the wine bottles. This patent also discloses a rack with an inclined flat member with spaced openings for receiving the necks of wine bottles in order to hold the bottles in essentially parallel relationship with the surface on which the rack is supported. U.S. Pat. No. 4,795,038 also discloses such a rack. Cole U.S. Pat. No. 4,496,124 discloses a similar rack for supporting a single bottle.

The rack of the present invention of the same general type as the racks described in the patents discussed above. However, the prior art bottle holders which support a bottle solely by its neck have required multiple parts which had to be separately manufactured and subsequently assembled together. These parts usually consists of a column which supports the bottle, and brackets or base which attach to and support the column. Because these bottle holders consist of at least two pieces of material, they have a rather ungainly appearance. Where a single element has been used for a prior art bottle holder (Cole U.S. Pat. No. 4,496,124), the bottle holding capacity was restricted to but a single bottle, and its construction offered no stability when the holder empty, and only limited stability when holding its one bottle.

The rack of the present invention is formed from a single piece of plastic material, such as acrylic, or other similar material. Because of its one-piece construction, it may be manufactured inexpensively and effectively, without in anyway impairing its ability to perform its intended function, which is to provide a sturdy and stable platform for the support of a multiple number of wine bottles, regardless of whether the rack is full, only partially full, or empty. By eliminating the need for attachments, brackets, screws, nails, clips, glue, etc., the one piece construction of the invention provides for a rack with a pleasing streamlined appearance.

Accordingly, the principal objectives of the invention are to provide a one-piece bottle rack which includes a planar base and an integral inclined planar apertured member formed at one end of the base. The inclined member serves to support a number of wine bottles one above the other, each extending along the base and generally spaced in parallel relationship to the base.

Other objectives of the invention are to provide such a rack which is inexpensive to produce, which is sturdy and stable in construction, and which has a pleasing appearance.

DETAILED DESCRIPTION OF THE INVENTION

The one piece rack of the present invention, as stated above, is preferably formed of a plastic material, such as acrylic. It has a planar base 10 which is intended to be supported on a table, or other horizontal surface. The base 10 has a rectangular configuration. A rectangular opening 12 is formed at one end of the base, and the opening extends inwardly from the end and terminates at a transverse axis 14. Extended arms 20 of base 10 are left on each side of the opening 12, and extend outwardly from transverse axis 14 on each side of the opening 12.

Figure 1:
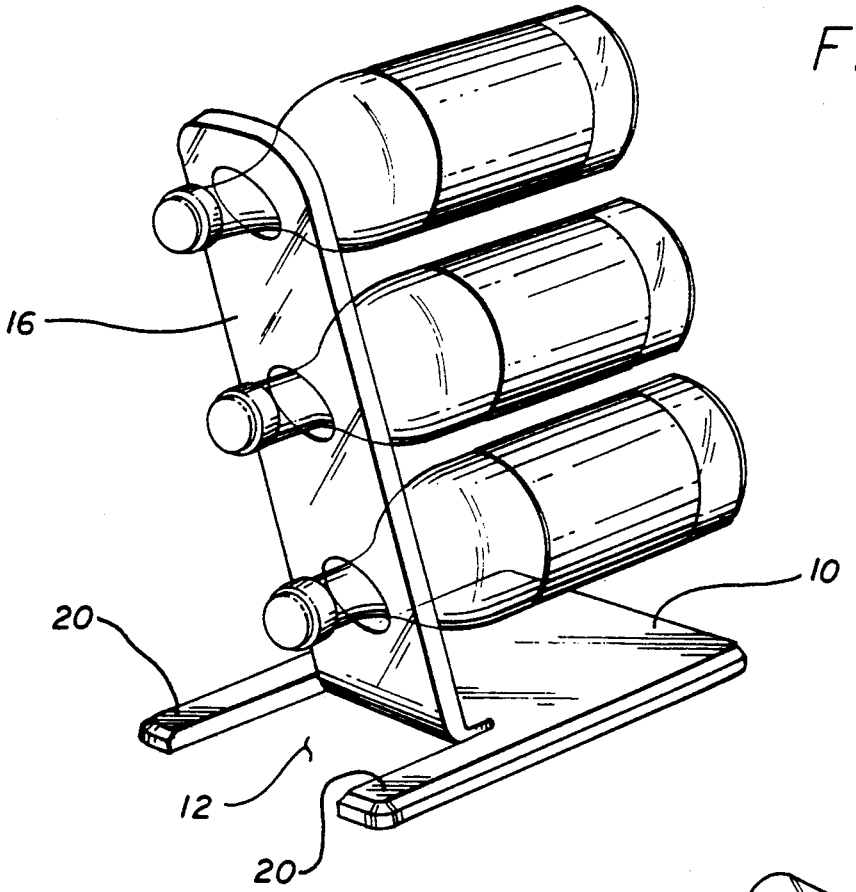
FIG. 1 is a perspective view showing the rack of the invention supporting a number of wine bottles.

A planar inclined member 16 is formed integral with the base at the transverse axis 14, and it is formed of the same piece of material as the base. The inclined member 16 is of a smaller width than the width of base 10, and it is the forming of this inclined member that renders the opening 12 in the base and the extended arms 20 of the base. The inclined member 16 has a number of holes 18 formed in it for receiving and supporting wine bottles by the neck, such as shown in FIG. 1, generally parallel to the base 10, and spaced from one another. The wine bottles each extend along the base toward the other end of the base, as shown in FIG. 1.

Figure 2:
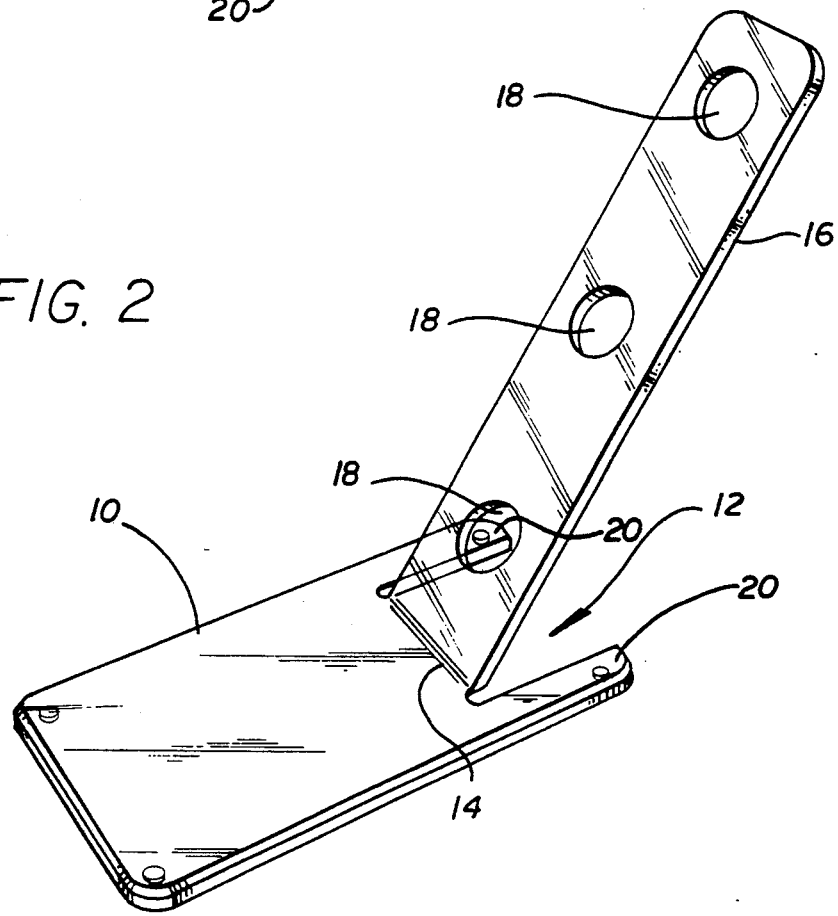
FIG. 2 is a perspective view like FIG. 1, but with the wine bottles removed.

The extended arms 20 of the base 10 help provide complete stability for the rack. This is particularly true when the rack is made to hold more than 2 bottles, such as with the 3 bottle rack shown in FIGS. 1 and 2. As an example, if this rack is holding a single bottle only, and the bottle is placed in the top hole 18 of inclined member 16, the combined center of gravity of the rack and bottle could be on the opening 12 side of the transverse axis 14 (depending on the density and thickness of the plastic material, and the length of base 10 measured from the transverse axis 14 to the end opposite opening 12). Without the extended arms 20, the rack and bottle combination would then be unstable with no support to prevent it from falling over toward opening 12.

If the inclined member 16 is made longer to hold more bottles, the extended arms 20 are made correspondingly longer to guarantee complete stability of the rack, whether it be full, partially full, or empty of wine bottles. In any of these situations, the combined center of gravity of the rack plus bottles it might be holding, no matter in which hole 18, will always be above a point inside of base 10, which includes extended arms 20.

There has been provided a unique, one-piece bottle holder/display rack with a simple, but sturdy construction, and a pleasing, streamlined appearance which will showcase one or more bottles in a most spectacular way. As mentioned earlier, the preferred material for the rack is a plastic material, such as acrylic. This material may be transparent, tinted, colored, textured, imprinted, etc.

While a particular embodiment of the invention has been shown and described, modifications may be made. It is intended in the claims to cover all modifications which come within the true spirit and scope of the invention.

I claim:

1. A one-piece bottle rack for the horizontal storage and display of long-necked bottles comprising: a planar rectangular base member having first and second ends and having a rectangular opening extending inwardly from said first end thereof and terminating at a transverse axis extending across the base member, said opening being bordered by support arms integral with the base member and extending outwardly from the transverse axis on each side of said opening toward said first end, an inclined planar ramp member formed integral with said base member at said transverse axis, said ramp member having a plurality of apertures therein for receiving the necks of and supporting one or more wine bottles in generally spaced and parallel relationship with one another and with the base and extending along the base toward the second end thereof, said planar base member including said support arms being of a size sufficient to provide a sturdy and stable platform for the rack when the rack is full, partially full or empty of bottles.

2. The one-piece bottle rack defined in claim 1, in which the planar base member and the planar ramp member are both formed of a plastic material, such as acrylic.

* * * * *